US007124919B1

(12) United States Patent
Sutton

(10) Patent No.: US 7,124,919 B1
(45) Date of Patent: Oct. 24, 2006

(54) CLAMP-TYPE GARMENT HANGER

(75) Inventor: Steven Sutton, Brooklyn, NY (US)

(73) Assignee: The Accessory Corporation, New York, NY (US)

( * ) Notice: Subject to any disclaimer, the term of this patent is extended or adjusted under 35 U.S.C. 154(b) by 455 days.

(21) Appl. No.: 10/676,992

(22) Filed: Oct. 2, 2003

Related U.S. Application Data

(63) Continuation-in-part of application No. 10/413,697, filed on Apr. 15, 2003, now Pat. No. 6,892,910.

(51) Int. Cl.
*A41D 27/22* (2006.01)

(52) U.S. Cl. ..... 223/85; 223/96

(58) Field of Classification Search ..... 223/85, 223/90–93, 95, 96, DIG. 2; D6/315, 323, D6/318, 319, 411
See application file for complete search history.

(56) References Cited

U.S. PATENT DOCUMENTS

| | | | | |
|---|---|---|---|---|
| 4,034,903 | A | 7/1977 | Batts | 223/96 |
| 4,759,480 | A * | 7/1988 | Duester et al. | 223/96 |
| 4,905,877 | A * | 3/1990 | Gatling | 223/90 |
| 5,113,554 | A | 5/1992 | Gallo et al. | 24/545 |
| D328,393 | S | 8/1992 | Spavold | D6/316 |
| 5,289,956 | A | 3/1994 | Petrou | 223/85 |
| 5,361,948 | A * | 11/1994 | Batts | 223/96 |
| D364,280 | S | 11/1995 | Maynard | D6/326 |
| D392,098 | S | 3/1998 | Finkelman | D3/315 |
| 5,934,525 | A | 8/1999 | Blanchard | 223/96 |
| 5,967,388 | A | 10/1999 | Kolton et al. | 223/95 |
| 5,975,384 | A * | 11/1999 | Manabat | 223/91 |
| 6,036,064 | A * | 3/2000 | Tawil | 223/88 |
| 2002/0108976 | A1 * | 8/2002 | Carmichael | 223/85 |
| 2003/0126725 | A1 | 7/2003 | Housley | 24/510 |

* cited by examiner

*Primary Examiner*—Gary L. Welch
(74) *Attorney, Agent, or Firm*—Gordon & Jacobson, P. C.

(57) ABSTRACT

A garment hanger includes a crossbar member, a hook member coupled to the crossbar member, and three clamp members coupled to the crossbar member. One of the three clamp members is disposed in a central region of the crossbar member. Two of the three clamp members are substantially disposed on opposite ends of the crossbar member. The clamp members are used to engage and support a garment, such as a pair of pants. Together, these elements can be used to reduce the vertical dimension of the garment held by the garment hanger.

14 Claims, 4 Drawing Sheets

CLAMP-TYPE GARMENT HANGER

CROSS-REFERENCE TO RELATED APPLICATION(S)

The present application is a continuation-in-part of commonly owned U.S. patent application Ser. No. 10/413,697 filed Apr. 15, 2003 now U.S. Pat. No. 6,892,910 to Capuano et al., herein incorporated by reference in its entirety.

BACKGROUND OF THE INVENTION

1. Field of the Invention

The present invention relates to clamp-type garment hangers.

2. State of the Art

Clamp-type garment hangers having two clamps are well-known for the suspension or hanging of garments such as pants, skirts, etc. The "pinch-type" clamp is a variety of clamp that has a pair of opposed jaw members between which a portion of the garment is secured. Provision is made for biasing the jaw members towards each other to create the clamping force necessary to retain a garment between inner surfaces of the jaw members. The jaw members are manipulated (typically by squeezing or pinching handles of the jaw members toward one another) to cause the jaw members to open to receive or release a garment. To further retain the garment between the inner surfaces of the members, the clamp or jaw members typically also include inner surface gripping elements or friction increasing surfaces.

While the known clamp-type hangers are useful in holding a variety of garments, long garments (such as pants) typically extend far below the garment hanger. This requires that a display rack that showcases such garments provide a large vertical dimension. The large vertical dimension limits the number of articles that can be made readily visible and presented to the customer for a given amount of wall space/display space. In addition, the large vertical dimension limits the suitability of the clamp-type hanger in space-limited environments such as shipping containers, cartons, and warehouses.

Thus, there remains a need in the art to provide an improved clamp-type garment hanger that enables a reduction in the vertical dimension of a garment held by the garment hanger.

SUMMARY OF THE INVENTION

It is therefore an object of the invention to provide a clamp-type garment hanging device which enables retailers to reduce the vertical dimension of a garment, such as pants, held by the garment hanging device.

It is another object of the invention to provide a clamp-type garment hanging device which enables retailers to readily display and present a large number of garments for a given amount of wall or display space.

It is a further object of the invention to provide a clamp-type garment hanging device which enables retailers to readily display and present a large number of garments in a space-limited environment.

It is an additional object of the invention to provide a clamp-type garment hanging device that enables a retailer to neatly and compactly display and present a garment to a potential customer.

Another object of the invention is to provide a clamp-type garment hanging device that permits more compact shipping of garments already hung on the clamp-type garment hanger.

A further object of the invention is to provide a clamp-type garment hanging device that provides a storage space savings for garments already hung on the hanger.

In accordance with the present invention, a garment hanging device includes a crossbar member, a hook member coupled to the crossbar member, and three clamp members coupled to the crossbar member. One of said three clamp members is disposed in a central region of the crossbar member. Two of said three clamp members are substantially disposed on opposite ends of the crossbar member. The clamp members are used to engage and support a garment, such as a pair of pants. Together, these elements can be used to reduce the vertical dimension of the garment held by the garment hanger. This enables a retailer to neatly and compactly display and present a garment to a potential customer. Moreover, it enables a garment display rack to securely showcase a larger number of articles than was previously possible. Further, it permits the shipping of more articles on hangers in a given container space and the storage of more goods in a given container or in a particular warehouse space.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
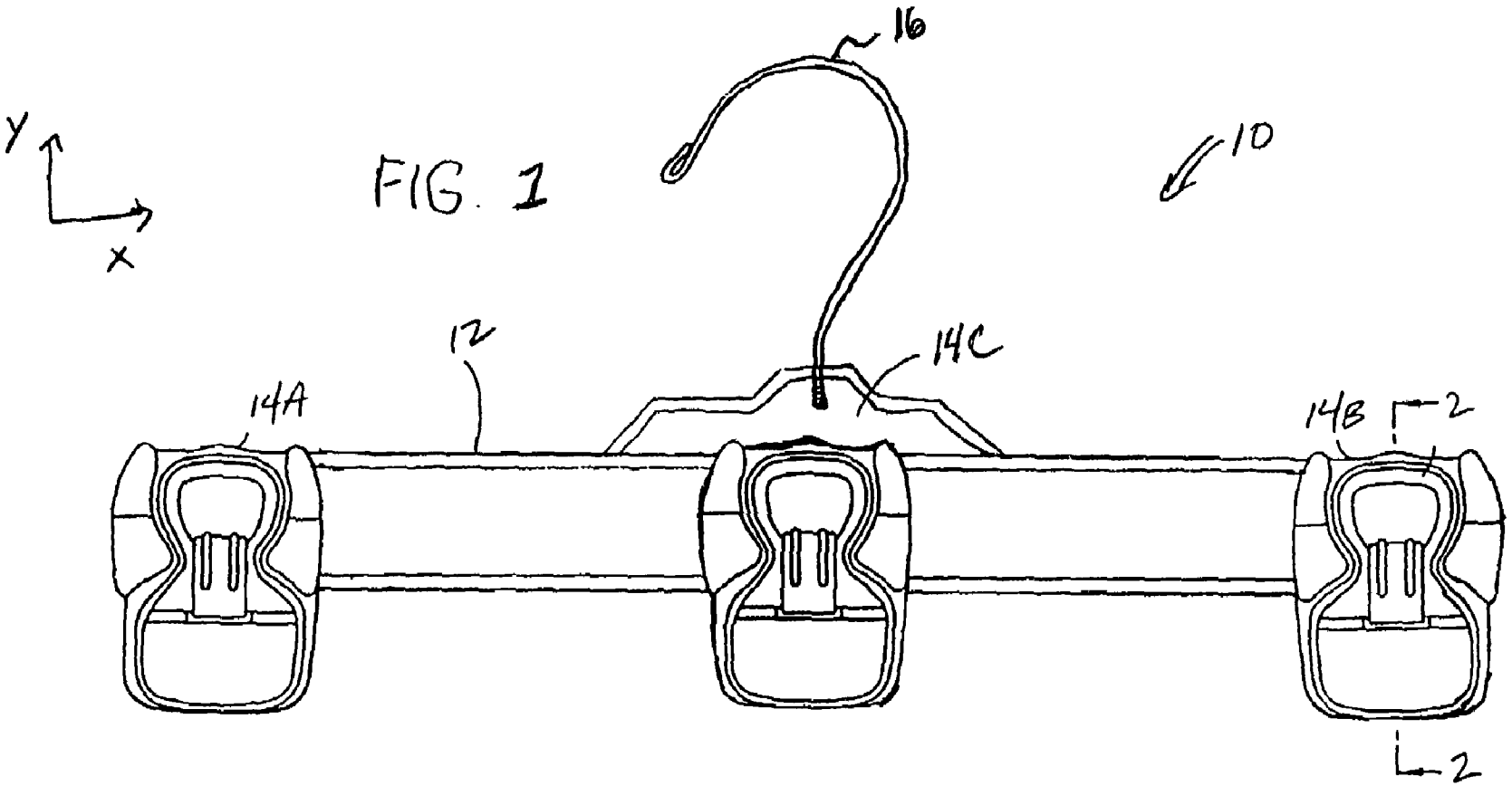
FIG. 1 is a front view of an exemplary embodiment of a clamp-type garment hanger in accordance with the present invention.
Figure 3:
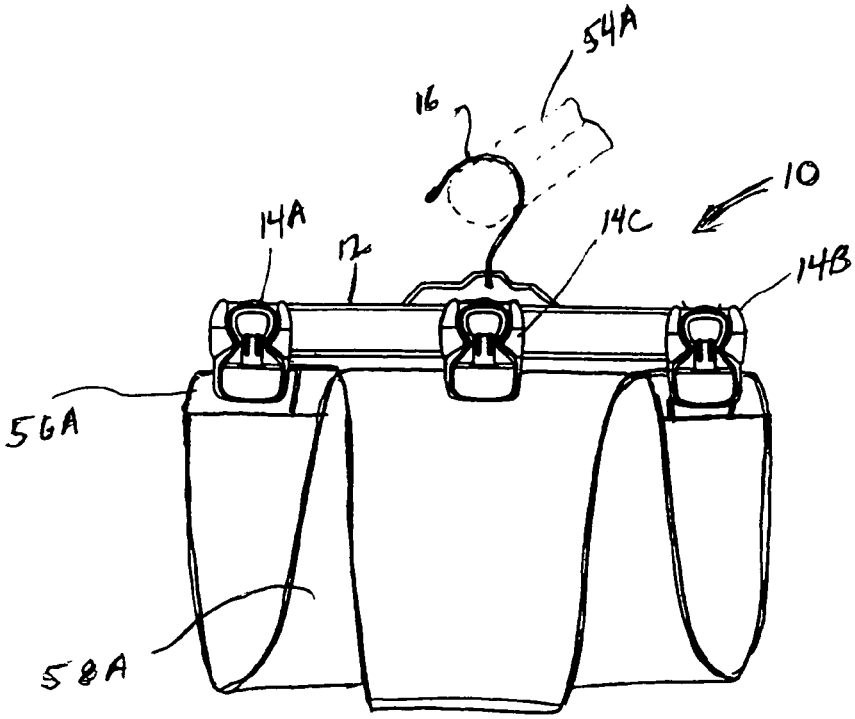
FIG. 3 is a front view of a display rack in which two exemplary hangers of FIG. 1 are used to hang two pairs of pants one under the other in the same vertical space normally required to hang one pair of pants.
Figure 3:
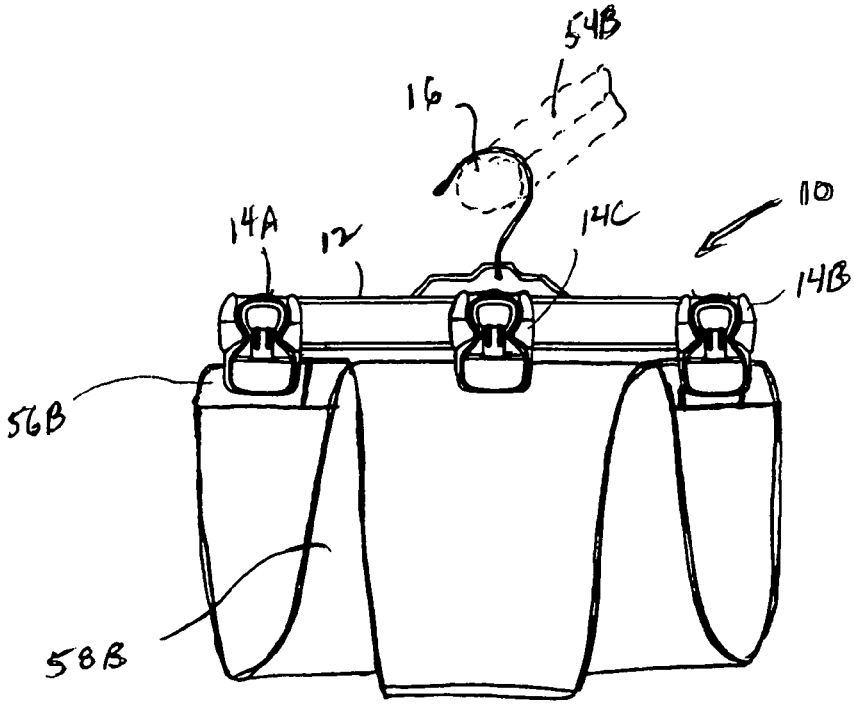
Figure 4:
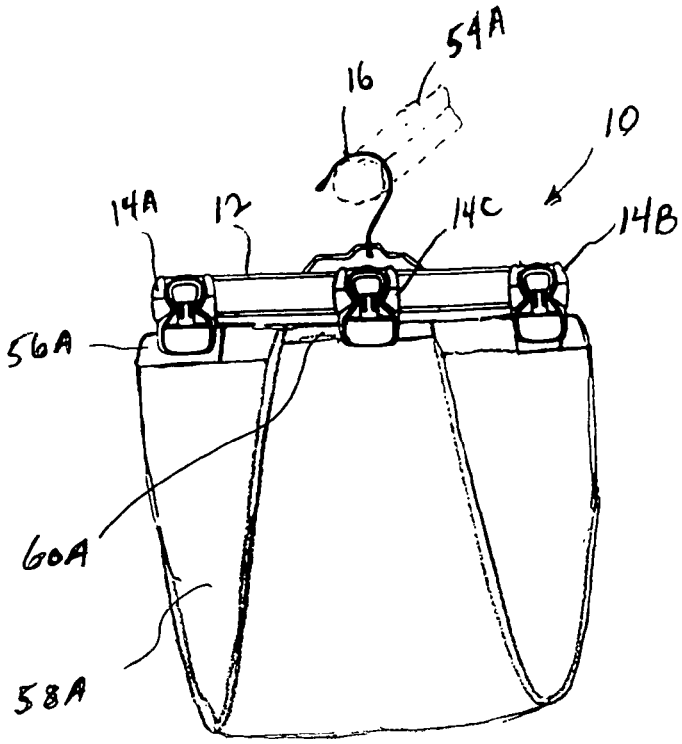
FIG. 4 is a front view of a display rack in which two exemplary hangers of FIG. 1 are used to hang two pairs of pants one under the other in a space-saving configuration.
Figure 4:
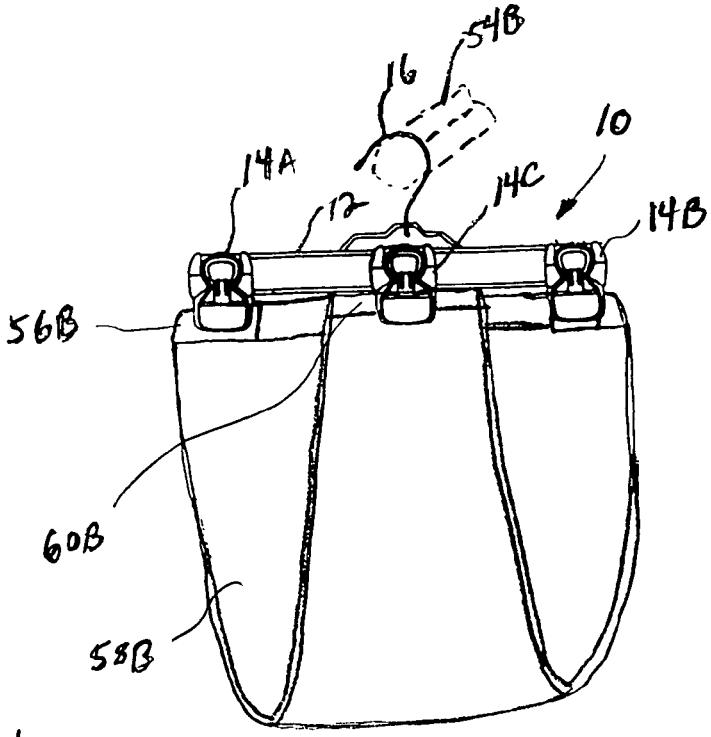

Referring now to FIG. 1, a garment hanger 10 includes an upper crossbar section 12 having three pinch-type clamps 14A, 14B, 14C. Two of the pinch-type clamps (14A, 14B) are preferably disposed at or near the ends of the upper cross-bar section 12 as shown. The third pinch-type clamp 14C is disposed at or near the center of the cross-bar section 12. A partial loop or hook member 16, which may be formed from plastic or metal wire or any other appropriate material, projects from the cross-bar section 12. Preferably, the hook member 16 projects from the center of the cross-bar section 12 and thus is substantially aligned with the third clamp 14C. The hook member 16 may be a wire secured via threads to the section 12 as shown, or may be integrally formed from the same material as the upper crossbar section 12, or may be connected to the section 12 in any other manner. The hook member 16 is used to hang the garment hanger 10 from a support, such as a bar or wire mesh or other support structure as is well known. As described below with respect to FIGS. 2A through 2C, the clamps 14A, 14B, 14C each include a fixed jaw and moveable jaw that are resiliently biased in a close spatial arrangement relative to one another by a spring clip. The jaws are used to engage and support a garment, such as a pair of pants. The spatial arrangement of the three clamps is designed such that the two outer clamps 14A and 14B (and possibly the central third clamp 14C) engage and support the waist of a pair of folded pants disposed therein, while the central third clamp 14C engages and supports portions of the legs of the pair of folded pants (as seen in FIGS. 3 and 4).

Preferably, the upper crossbar section 12 and the fixed jaw of the three clamps 14A, 14B, 14C are molded unitary and integral to one another. Preferably these elements, along with the moveable jaw of clamps 14A, 14B, 14C, are formed by molding any one of a number of well known plastic or resin materials, such as "k"-resin, polystyrene, polystyrene blends, polypropylene, polyethylene, styrene-butadiene copolymers and blends, polycarbonates, and combinations thereof. Alternatively, the clamps may be provided with rubber or synthetic pads as is well known in the art, or the pad portion of the clamp may be formed by a coinjection molding process as is also well known in the art. If desired, one of the clamps can be different from the other two, or all three can differ in construction.

Figure 2B:
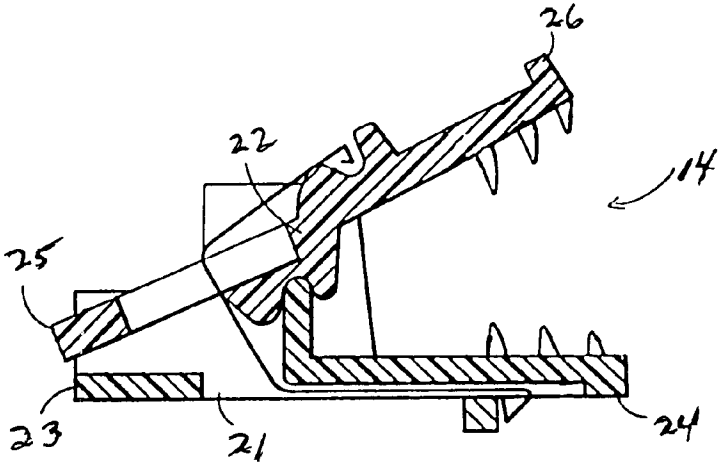
FIGS. 2A, 2B and 2C are sectional views along line 2—2 of the exemplary garment clamp of the garment hanger of FIG. 1 with FIG. 2A showing the garment clamp with its jaw members in a fully closed position, FIG. 2B showing the garment clamp with its jaw members in a fully open position, and FIG. 2C showing the garment clamp with its jaw members shown closed on a portion of a garment.
Figure 2A:
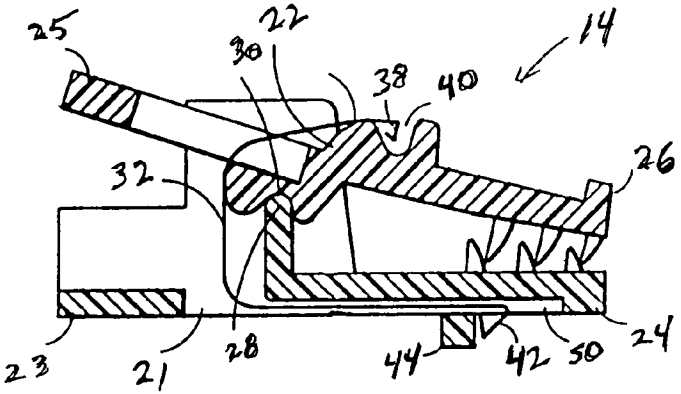

Referring now to FIGS. 2A and 2B, each clamp 14 has a back base member 21 which is preferably integrally formed with the top crossbar section 12, and a front lever member 22 movable relative thereto. The base member 21 includes a handle portion 23 and a jaw end 24. The lever member 22 includes a handle portion 25 which is opposite the handle portion 23, and a jaw end 26 which is positioned opposite the jaw end 24. The lever member 22 is pivotally supported on the base member 21 along a pivot wall 28 on the base member 21. The pivot wall 28 is received in a pivot groove 30 on the back of lever member 22. A C-shaped spring clip 32, preferably made of metal, is dimensioned to receive a portion of the base member 21 and a portion of the lever member 22 and is positioned over those portions such that facing inner surfaces of the spring clip 32 bear against outwardly facing surfaces of the base member 21 and the lever member 22, respectively. A front end of the spring clip 32 has a flange 38 that engages within an aperture 40 in the lever member 22 to secure the spring clip 32 to the lever member. A rear end of the spring clip 32 has a tab 42 which engages a strut 44 spanning an aperture 50 in the base member 21 to secure the spring clip to the base member. The spring clip 32 urges the lever member jaw end 26 towards the base member jaw end 24. The jaws of the lever member 22 and the base member 21 are used to support a garment 52 as shown in FIG. 2C.

Figure 2C:
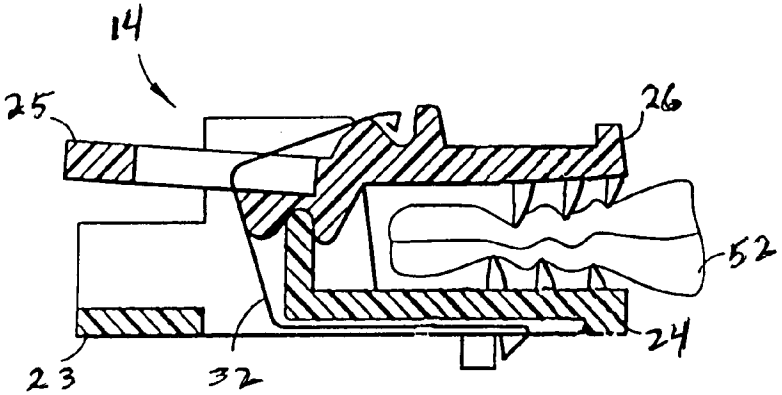

The inner surfaces of the jaws of the clamp may include teeth as shown in FIGS. 2A–2C. The teeth grip the garment disposed therebetween. Alternative, the inner surfaces of the jaws of the clamp may include ridges or "Crease Free" surfaces or other surfaces that grip the garment disposed therebetween. Exemplary configurations of garment hangers that use jaws with teeth are shown in co-owned U.S. Pat. No. 6,609,641. Exemplary configurations of garment hangers that use jaws with ridges are shown in U.S. Patent Application No. 2003/0126725. Exemplary configurations of garment hangers that use jaws with "Crease-Free" surfaces are shown in co-owned U.S. Pat. No. 6,199,728. If desired, one of the jaws may have one type of inner surface while the other jaws have a second type. Or, if desired, all three jaws may have the same or different surfaces.

The jaws of the clamps of the hanger device are used to engage and support a garment, such as a pair of pants. Together, these elements can be used to reduce the vertical dimension of the garment. For example, consider utilizing two garment hangers in accordance with the present invention to hang two pairs of pants one under the other as shown in FIG. 3. In this case, the hook members 16 of the respective hangers 10 are supported by support members 54A, 54B extending from a vertical post (not shown). The outer clamps 14A, 14B (and possibly clamp 14C) of the respective hangers are used to grasp onto the waists 56A, 56B of the pants. The pant legs 58A, 58B are neatly folded together and then supported by the central clamp 14C of the hangers such that sections of the folded pant legs overlap one another in the vertical dimension as shown. In this manner, the vertical dimension of the pants is significantly reduced while maintaining a neat and orderly presentation to the customer. In fact, the hangers with the pants may be placed one under the other and take up the same amount of room as one prior art hanger with one pair of pants.

In another example, consider utilizing a garment hanger in accordance with the present invention to hang two pairs of pants one under the other as shown in FIG. 4. In this case, the hook members 16 of the respective hangers 10 are supported by support members 54A, 54B extending from a vertical post (not shown). The outer clamps 14A, 14B (and possibly clamp 14C) of the respective hangers are used to grasp onto the waists 56A, 56B of the pants. The pant legs 58A, 58B are neatly folded together and the ends 60A, 60B of the folded pant legs are supported by the central clamp 14C of the hangers such that sections of the folded pant legs overlap one another in the vertical dimension as shown. In this manner, the vertical dimension of the pants is significantly reduced while maintaining a neat and orderly presentation to the customer. In fact, the hangers with the pants may be placed one under the other in the space-saving configuration as shown. Indeed, the configurations shown in FIGS. 3 and 4 provide space savings for storage of the already-hung garments in transport containers, cartons, and in warehouses.

The garment hanger device of the present invention can be readily adapted for use in hanging other garments, such as a skirt. To hang such a skirt, the two outer clamps 14A and 14B (and possibly the central third clamp 14C) can engage and support the bottom of the skirt, while the central third clamp 14C engages and supports the waist of the skirt. Alternatively, the two outer clamps 14A and 14B can engage and support the waist of the skirt while the central third clamp 14C (and if desired the two outer clamps 14A and 14B) engages the bottom of the skirt.

Advantageously, the garment hanging device of the present invention enables retailers to reduce the vertical dimension of a garment held by the clamp-type garment hanging device. This enables a large number of articles to be readily displayed and presented to potential customers for a given amount of wall or display space. Moreover, it enables a large number of articles to be readily displayed and presented in a space-limited retailed environment. Further, when garments are shipped with the garment on the hanger device, it enables a large number of articles on hangers to ship in a given container space or in cartons. Finally, the garment hanging device of the invention can be used to reduce warehouse storage requirements.

There have been described and illustrated herein embodiments of clamp-type garment hanger. While particular embodiments of the invention have been described, it is not intended that the invention be limited thereto, as it is intended that the invention be as broad in scope as the art will allow and that the specification be read likewise. Thus, while a particular garment clamping mechanism has been disclosed, it will be appreciated that other clamp mechanisms may be used. In addition, while the clamp is shown securely attached to the hanger body as an integral part of hanger body, it will be understood that this attachment method is merely illustrative of the most cost effective method of manufacturing a sturdy, attractive hanger. Furthermore, the clamp may alternatively be made separately from a material that is the same or different from the material of hanger body, and may be fixedly or movably attached to the hanger body by known means or methods. Moreover, the clamp may also be attached to hanger body by one or more intervening elements, such as, for example, a bar or rod (not shown) supported below the hanger body. In addition, while straight crossbar members are shown, it will be appreciated that the term "crossbar" is intended to be broad and include cross members which are curved or otherwise shaped. Also, while the invention was described as being advantageously used in conjunction with particular garments such as pants and skirts, it will be appreciated that the garment hanger can be used in conjunction with other garments such as slips, stockings, leggings and various two-piece sets. It will therefore be appreciated by those skilled in the art that yet other modifications could be made to the provided invention without deviating from its spirit and scope as claimed.

What is claimed is:

1. A garment hanger, consisting essentially of:

a) a hook;

b) a substantially straight crossbar having substantially straight parallel top and bottom surfaces and middle neck portion receiving said hook;

c) exactly three clamps, wherein each clamp includes a first member integral with said crossbar and extending from said crossbar downward beyond said bottom surface, a second member which pivots relative to said first member, and a spring clip coupled to said first member and said second member, a first of said three clamps is disposed in a central region of said crossbar, and wherein a second and a third of said three clamps are substantially disposed on opposite ends of said crossbar.

2. A garment hanger according to claim 1, wherein:

said first clamp is substantially vertically aligned with said hook.

3. A garment hanger according to claim 1, wherein:

each clamp member has a jaw extending below said bottom surface.

4. A garment hanger according to claim 1, wherein:

said crossbar and said clamp members are plastic.

5. A method of hanging a garment comprising the steps of:

a) providing a garment hanger consisting essentially of a hook, a substantially straight crossbar having substantially straight parallel top and bottom surfaces and middle neck portion receiving said hook, exactly three clamps, wherein each clamp includes a first member integral with said crossbar and extending from said crossbar downward beyond said bottom surface, a second member which pivots relative to said first member, and a spring clip coupled to said first member and said second member, wherein a first of said three clamps is disposed in a central region of said crossbar, and wherein a second and a third of said three clamps are substantially disposed on opposite ends of said crossbar;

b) manipulating said second and third clamps to grasp onto a first section of said garment; and c) manipulating said first clamp to grasp onto a second section of said garment.

6. A method of hanging a garment according to claim 5, wherein:

step c) includes grasping onto the first section of said garment.

7. A method of hanging a garment according to claim 5, wherein:

said garment comprises pants, said first section comprises a waist section of said pants, and said second section comprises either portions of folded legs of said pants or ends of the legs of said pants.

8. A method of displaying a plurality of garments comprising the steps of:

a) providing a plurality of garment hangers corresponding to said plurality of garments, each garment hanger consisting essentially of a hook, a substantially straight crossbar having substantially straight parallel top and bottom surfaces and middle neck portion receiving said hook, exactly three clamps, wherein each clamp includes a first member integral with said crossbar and extending from said crossbar downward beyond said bottom surface, a second member which pivots relative to said first member, and a spring clip coupled to said first member and said second member, wherein a first of said three clamps is disposed in a central region of said crossbar, and a second and a third of said three clamps are substantially disposed on opposite ends of said crossbar;

b) for each garment hanger and corresponding garment, manipulating said second and third clamps to grasp onto a first section of the corresponding garment, and manipulating said first clamp to grasp onto a second section of the corresponding garment; and c) arranging the garment hangers and corresponding garments supported thereon one under the other.

9. A method of displaying a plurality of garments according to claim 8, wherein:

step b) includes manipulating said first clamp member to grasp onto the first section of said garment.

10. A method of displaying a plurality of garments according to claim 8, wherein:

at least one of said garments comprises pants, said first section comprises a waist section of said pants, and said second section comprises either portions of folded legs of said pants or ends of the legs of said pants.

11. A method of storing a plurality of garments comprising the steps of:

a) providing a plurality of garment hangers corresponding to said plurality of garments, each garment hanger consisting essentially of a hook, a substantially straight crossbar having substantially straight parallel top and bottom surfaces and middle neck portion receiving said hook, exactly three clamps, wherein each clamp includes a first member integral with said crossbar and extending from said crossbar downward beyond said bottom surface, a second member which pivots relative to said first member, and a spring clip coupled to said first member and said second member, wherein a first of said three clamps is disposed in a central region of said crossbar, and a second and a third of said three clamps are substantially disposed on opposite ends of said crossbar;

b) for each garment hanger and corresponding garment, manipulating said second and third clamps to grasp onto a first section of the corresponding garment, and manipulating said first clamp to grasp onto a second section of the corresponding garment; and c) storing the garment hangers and their corresponding garments with the garment hangers attached to their corresponding garments in a carton, shipping container, or warehouse.

12. A method according to claim 11, wherein:

step b) includes manipulating said first clamp to grasp onto the first section of said garment.

13. A method according to claim 11, wherein:

at least one of said garments comprises pants, said first section comprises a waist section of said pants, and said second section comprises either portions of folded legs of said pants or ends of the legs of said pants.

14. A method according to claim 11, further comprising:

d) shipping said garment hangers and their corresponding garments with the garment hangers attached to their corresponding garments in said carton or said shipping container.

* * * * *